US008695414B2

(12) United States Patent
Pelletier

(10) Patent No.: US 8,695,414 B2
(45) Date of Patent: Apr. 15, 2014

(54) HIGH PRESSURE AND FLOW RATE PUMP USEFUL IN FORMATION FLUID SAMPLE TESTING

(75) Inventor: Michael T. Pelletier, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 93 days.

(21) Appl. No.: 13/528,560

(22) Filed: Jun. 20, 2012

(65) Prior Publication Data

US 2013/0014576 A1 Jan. 17, 2013

(30) Foreign Application Priority Data

Jul. 12, 2011 (WO) ..... PCT/US2011/043641

(51) Int. Cl.
*E21B 49/10* (2006.01)

(52) U.S. Cl.
USPC ..... 73/152.24

(58) Field of Classification Search
USPC ..... 73/19.05, 152.18, 152.24
See application file for complete search history.

(56) References Cited

U.S. PATENT DOCUMENTS

| | | | | |
|---|---|---|---|---|
| 3,740,169 | A | 6/1973 | Papen | |
| 4,526,000 | A | 7/1985 | Saurwein | |
| 4,659,294 | A | 4/1987 | Barthomeuf | |
| 4,747,758 | A | 5/1988 | Saurwein | |
| 5,303,775 | A * | 4/1994 | Michaels et al. | 166/264 |
| 5,377,755 | A * | 1/1995 | Michaels et al. | 166/264 |
| 5,470,535 | A * | 11/1995 | Ray et al. | 422/534 |
| 5,587,525 | A * | 12/1996 | Shwe et al. | 73/152.52 |
| 5,635,631 | A * | 6/1997 | Yesudas et al. | 73/61.46 |
| 7,062,958 | B2 | 6/2006 | Diakonov et al. | |
| 7,083,009 | B2 | 8/2006 | Paluch et al. | |
| 7,198,105 | B2 | 4/2007 | Grant et al. | |
| 7,258,167 | B2 | 8/2007 | Shammai et al. | |
| 7,581,435 | B2 * | 9/2009 | Pelletier | 73/54.02 |
| 8,431,413 | B2 * | 4/2013 | Dority et al. | 436/500 |

FOREIGN PATENT DOCUMENTS

EP 1269026 B1 12/2003

OTHER PUBLICATIONS

International Search Report with Written Opinion issued Dec. 26, 2011 for PCT Patent Application No. PCT/US11/043641, 8 pages.

(Continued)

*Primary Examiner* — Hezron E Williams
*Assistant Examiner* — David Z Huang
(74) *Attorney, Agent, or Firm* — Smith IP Services, P.C.

(57) ABSTRACT

A pump can include two pistons, each piston having one side exposed to a support pressure and another side exposed to a respective annular chamber, the chambers being pressurized greater than the support pressure. Fluid can be discharged from one annular chamber and received into the other annular chamber by displacement of the pistons. A method of testing a fluid can include pressurizing the fluid in response to increasing a support pressure exposed to one side of each of two pistons, thereby increasing pressure in chambers exposed to respective other sides of the pistons, and then displacing the pistons, thereby flowing the fluid through a test manifold assembly. A fluid test system can include a pump having a support pressure exposed to sides of two pistons, and another side of each of the pistons being exposed to a respective annular chamber. Each annular chamber can be connected to a sensor.

28 Claims, 6 Drawing Sheets

(56) References Cited

OTHER PUBLICATIONS

Haskel International, Inc.; "Gas Booster Catalog", Product catalog, dated 2005, 29 pages.
Haskel International, Inc.; "Pneumatic Driven Liquid Pumps", product brochure, dated Oct. 2009, 24 pages.
Chandler Engineering; "Quizix Q5000: Precision Metering Pumps", product article, dated 2008, 2 pages.
Chandler Engineering; "Quizix Q6000: Precision Metering Pumps", product article, dated 2008, 2 pages.
Vindum Engineering, Inc.; "Quizix Pump Systems", specification, dated 1995-2011, 2 pages.
DH Insturments; "GB-75 and GB-152: Gas Booster with Control Kit", operation and maintenance manual, dated 1998-2008, 28 pages.
The Department of Chemical Engineering(The University of Colorado at Boulder); "Chemically Assisted in SITU Recovery of Oil Shale", project report, dated Sep. 5, 1989, 50 pages.
Ruska Instrument Corporation; "Model 7310/7610: High Pressure Pneumatic and Hydraulic Controllers", document 9805-0011, dated 1998, 4 pages.
Ruska Instrument Corporation; "Accessories; for Pressure Calibrators", document 0002-accessa, dated 1998, 4 pages.
Schlumberger; "High-Pressure Displacement Pumps", article No. 07-WT-118, dated 2007, 1 page.
Search Report issued Dec. 26, 2011 for International Application No. PCT/US11/43641, 5 pages.
Written Opinion issued Dec. 26, 2011 for International Application No. PCT/US11/43641, 3 pages.

* cited by examiner

HIGH PRESSURE AND FLOW RATE PUMP USEFUL IN FORMATION FLUID SAMPLE TESTING

CROSS-REFERENCE TO RELATED APPLICATION

This application claims the benefit under 35 USC §119 of the filing date of International Application Serial No. PCT/US11/43641 filed 12 Jul. 2011. The entire disclosure of this prior application is incorporated herein by this reference.

BACKGROUND

This disclosure relates generally to equipment utilized and operations performed in conjunction with a subterranean well and, in an embodiment described herein, more particularly provides to the art a high pressure and flow rate pump useful in formation fluid sample testing.

It is beneficial to be able to test properties of a formation fluid sample at or near conditions of the sample in an earth formation from which the sample originated. Thus, it is useful to construct test systems which can conveniently and economically pressurize and/or heat a sample, and measure the properties of the sample.

Accordingly, it will be appreciated that improvements are continually needed in the art of constructing formation fluid sample test systems. These improvements can be useful in other arts, as well.

DETAILED DESCRIPTION

Figure 1:
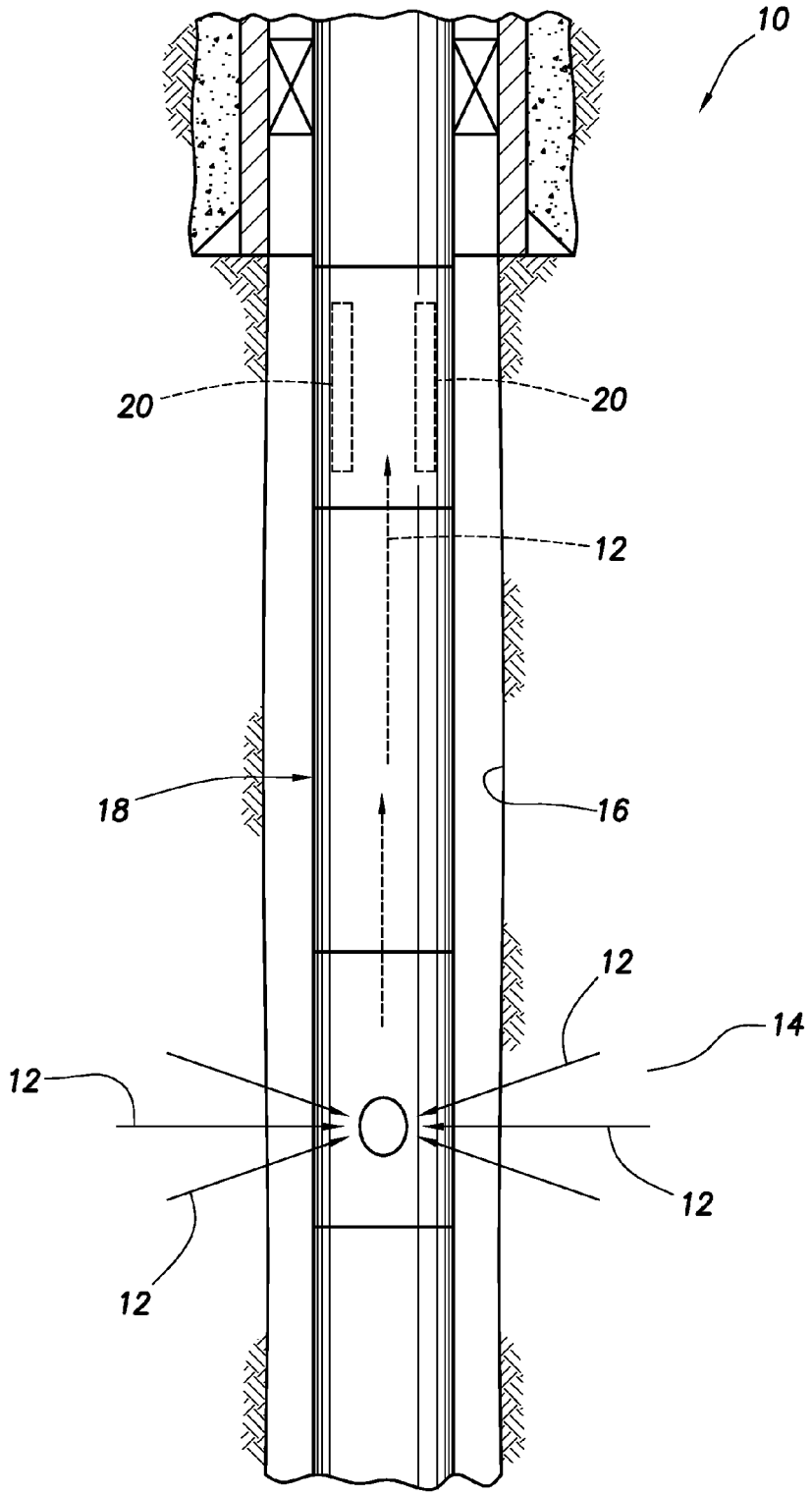
FIG. 1 is a representative partially cross-sectional view of a well in which a formation fluid sample is obtained.

Representatively illustrated in FIG. 1 is a well 10 and associated method, in which a formation fluid 12 is received from an earth formation 14 into a wellbore 16. In the wellbore 16, the fluid 12 is flowed into a test tool assembly 18, which includes sample chambers 20 for containing and transporting samples of the fluid to the surface.

At this point it should be noted that the well 10 is described here as merely one example of a source for a sample of the fluid 12. The fluid 12 sample may be obtained using any of a variety of different techniques in keeping with the scope of this disclosure.

The well 10 could be an oil and/or gas well, a geothermal well, a production well, an injection well, or any other type of well. Therefore, it should be clearly understood that the principles of this disclosure are not limited at all to the details of the well 10 depicted in the drawings or described herein.

Once retrieved to the surface, it is desired to test the fluid 12 sample. Any purpose may be served by such testing, including determining characteristics of the fluid 12, evaluating economical viability of producing the fluid, determining completion options, etc. Preferably, the testing is conducted while the fluid 12 sample is in the same condition as when it was in the formation 14.

Figure 2:
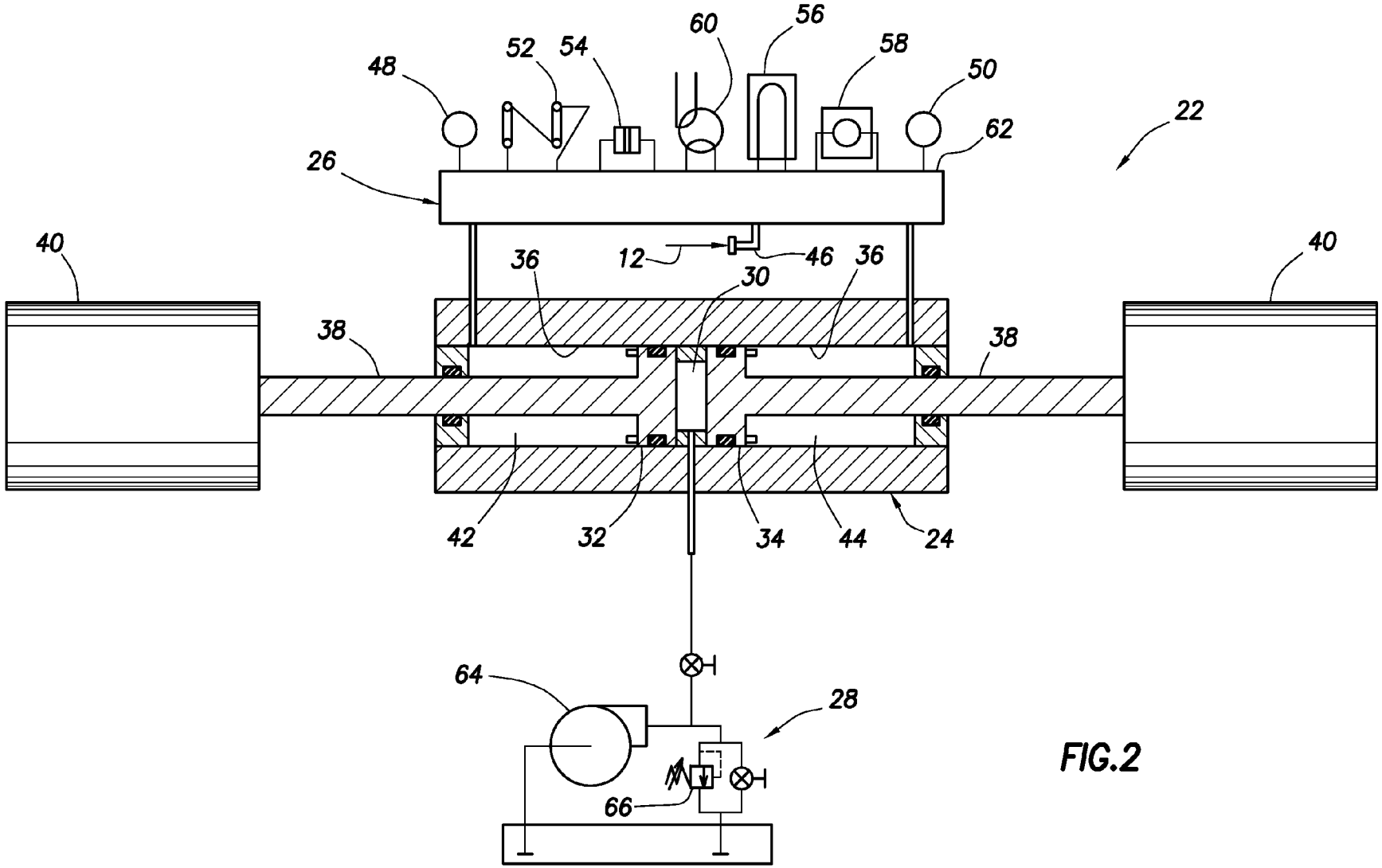
FIG. 2 is a representative partially cross-sectional diagram of a fluid test system and associated method which can embody principles of this disclosure.

Referring additionally now to FIG. 2, a fluid test system 22 and associated method which can embody principles of this disclosure, and which may be used for testing the fluid 12 sample, is representatively illustrated. The fluid test system 22 can be used for testing other fluids, whether or not they originated from an earth formation, in keeping with the scope of this disclosure.

In the example depicted in FIG. 2, the test system 22 includes a pump 24, a fluid test manifold assembly 26 and a pressure source 28. The pressure source 28 is connected to a support pressure chamber 30 positioned between two opposing pistons 32, 34 of the pump 24.

Each of the pistons 32, 34 is disposed in a cylindrical bore 36. A cylindrical rod 38 extends between each piston 32, 34 and a respective actuator 40. Annular chambers 42, 44 are formed radially between the bores 36 and the rods 38.

In this example, the fluid 12 sample is introduced to the fluid test system 22 via a port 46 of the manifold assembly 26. The manifold assembly 26 preferably comprises various fluid property sensors, including pressure and temperature sensors 48, 50, a viscosity coil 52, an optical sensor 54, a densitometer 56, an acoustic sensor 58, etc. However, any other number, types or combinations of fluid property sensors may be used in keeping with the scope of this disclosure.

The manifold assembly 26 also preferably comprises a test manifold 62 with various valves and other flow control devices (not illustrated) for directing the fluid 12 through the manifold assembly. For example, valves may be provided to direct the fluid 12 to each of the various sensors 48, 50, 52, 54, 56, 58, to direct the fluid to bypass selected ones of the sensors, etc. The manifold assembly 26 can also include other devices, such as a sampler 60, etc. A suitable test manifold is described in U.S. Pat. No. 7,581,435, although other test manifolds may be used in keeping with the principles of this disclosure.

The fluid 12 sample which enters the test manifold 62 via the port 46 is directed into the annular chambers 42, 44. At this point, the fluid 12 sample may not be at a desired elevated pressure for the test (such as, the same, or nearly the same, pressure as in the formation 14 from which the sample originated).

In that case, the sample pressure can be increased by increasing pressure in the chamber 30 between the pistons 32, 34. The pressure source 28 is operated to increase the pressure in the chamber 30.

The pressure source 28 preferably includes a hydraulic pump 64 and a variable pressure regulator 66 to control the pressure in the chamber 30. However, other types of pressure sources (such as, pressurized gas, etc.) and means of controlling pressure in the chamber 30 could be used in other examples.

Figure 3:
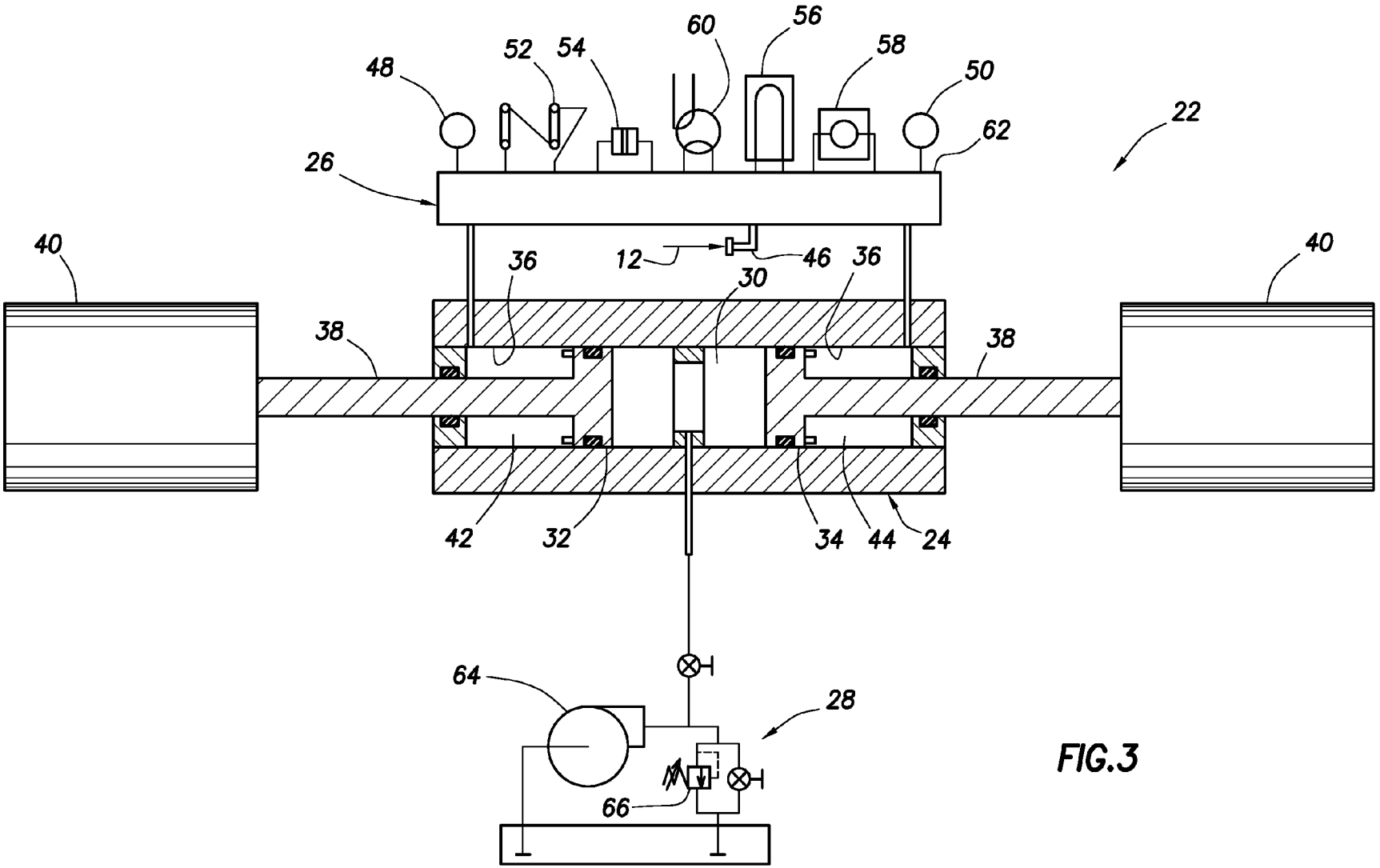
FIGS. 3-5 are representative partially cross-sectional views of the fluid test system as a series of steps in the method are performed.

Referring additionally now to FIG. 3, the test system 22 is depicted after pressure in the chamber 30 has been increased. Note that the volume of the chamber 30 is increased, due to the fluid 12 in the annular chambers 42, 44 being compressed. The volumes of the annular chambers 42, 44 are consequently reduced as the pistons 32, 34 displace outwardly away from each other.

The annular chambers 42, 44 are pressurized to a higher pressure than the chamber 30, due to a reduced piston area being exposed to the annular chambers 42, 44 on one side of the pistons 32, 34, as compared to the piston area exposed to the chamber 30 on the opposite sides of the pistons. Nominally, a ratio of the pressures in the chambers 30, 42, 44 (and on ends of the rods 38) is inversely proportional to a ratio of the piston areas exposed to the respective pressures.

In practice, the ratios are not strictly proportional due to, for example, friction effects, etc. However, a desired ratio of pressures between the chambers 30, 42, 44 can be readily achieved in practice, without requiring undue experimentation (for example, by manipulating the piston areas, mitigating friction effects and making adjustments based on empirical testing, etc.).

Figure 4:
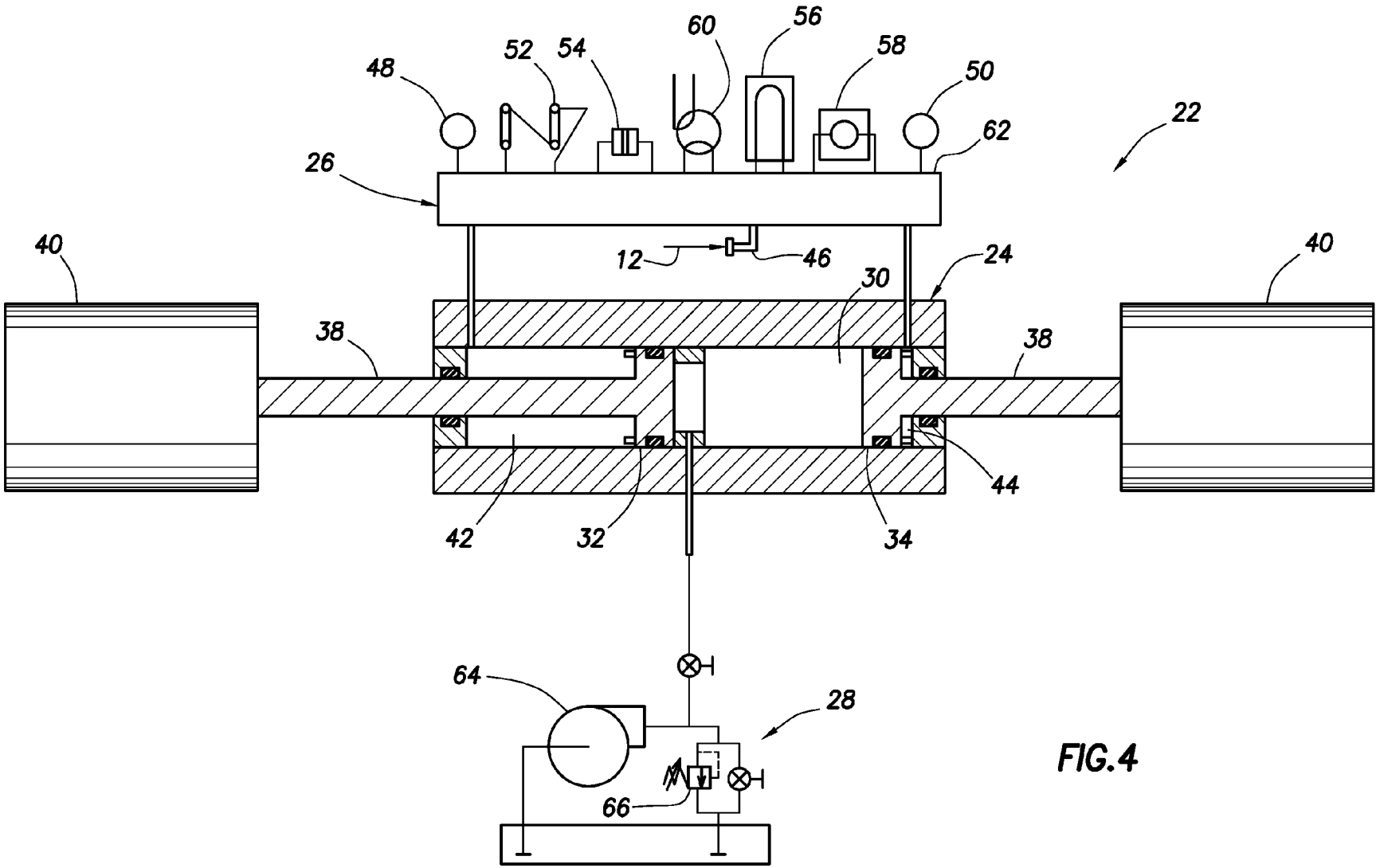

Referring additionally now to FIG. 4, the test system 22 is depicted after the actuator 40 has been used to displace the piston 32 to the right as viewed in the figure. In this manner, the fluid 12 can be discharged from one of the annular chambers 44, flowed through the test manifold 62, and received into the other annular chamber 42.

The volume of the annular chamber 42 increases as the piston 32 is displaced to the right, the volume of the chamber 30 remains substantially the same if the fluid therein is highly incompressible, and the volume of the annular chamber 44 decreases as the piston 34 is displaced to the right.

Note that either or both of the actuators 40 can be used to displace the pistons 32, 34 in this example. Thus, only one actuator 40 could be used, if desired.

The actuators 40 may be any type of actuators (such as motorized, hydraulic, pneumatic, etc.), but for use at a well site or other area in which flammable gases may exist, the actuators 40 are preferably explosion proof, and most preferably non-electric. The actuators 40 may also include position indicating devices (such as linear variable resistors, optical position indicators, etc.), so that the positions and speeds of the pistons 32, 34 can be measured, and the flow rate of the fluid 12 can be readily determined. Preferably, the actuators 40 are capable of rapidly displacing the pistons 32, 34 to thereby cause a relatively high rate of flow of the fluid 12 through the test manifold 62.

Figure 5:
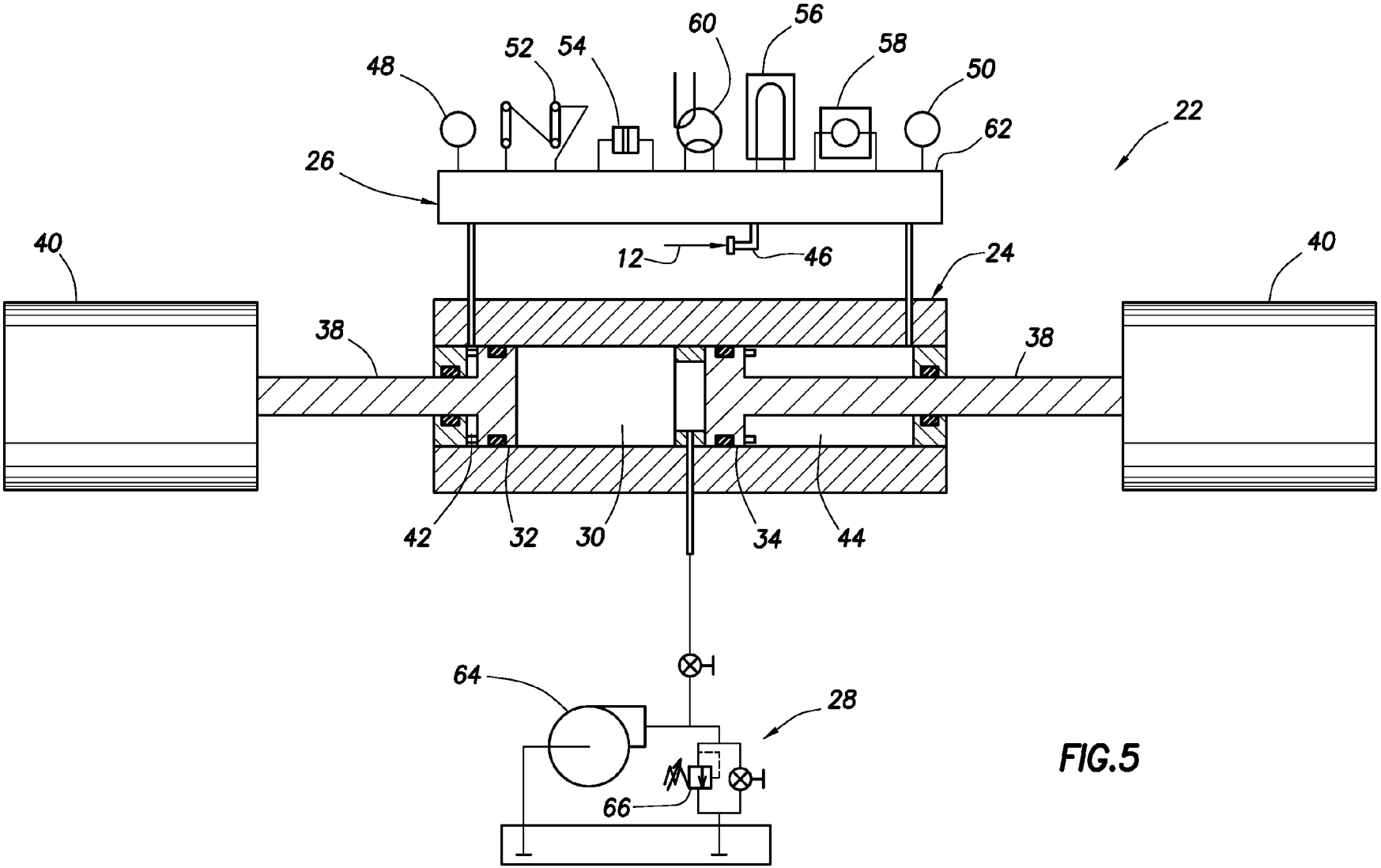

Referring additionally now to FIG. 5, the test system 22 is depicted after one or both of the actuators 40 has displaced the pistons 32, 34 to the left as viewed in the figure. The volume of the annular chamber 44 has, thus, increased and the volume of the other annular chamber 42 has decreased, thereby flowing the fluid 12 sample from annular chamber 42 to annular chamber 44 via the test manifold 62.

By alternately displacing the pistons 32, 34 repeatedly between their FIGS. 4 & 5 positions, the fluid 12 sample can be flowed back and forth between opposite ends of the test manifold 62, for example, to homogenize the sample. Flowing of the sample can be done at relatively high pressures and at relatively high flow rates, in this example, due to the construction of the pump 24 as described above.

Figure 6:
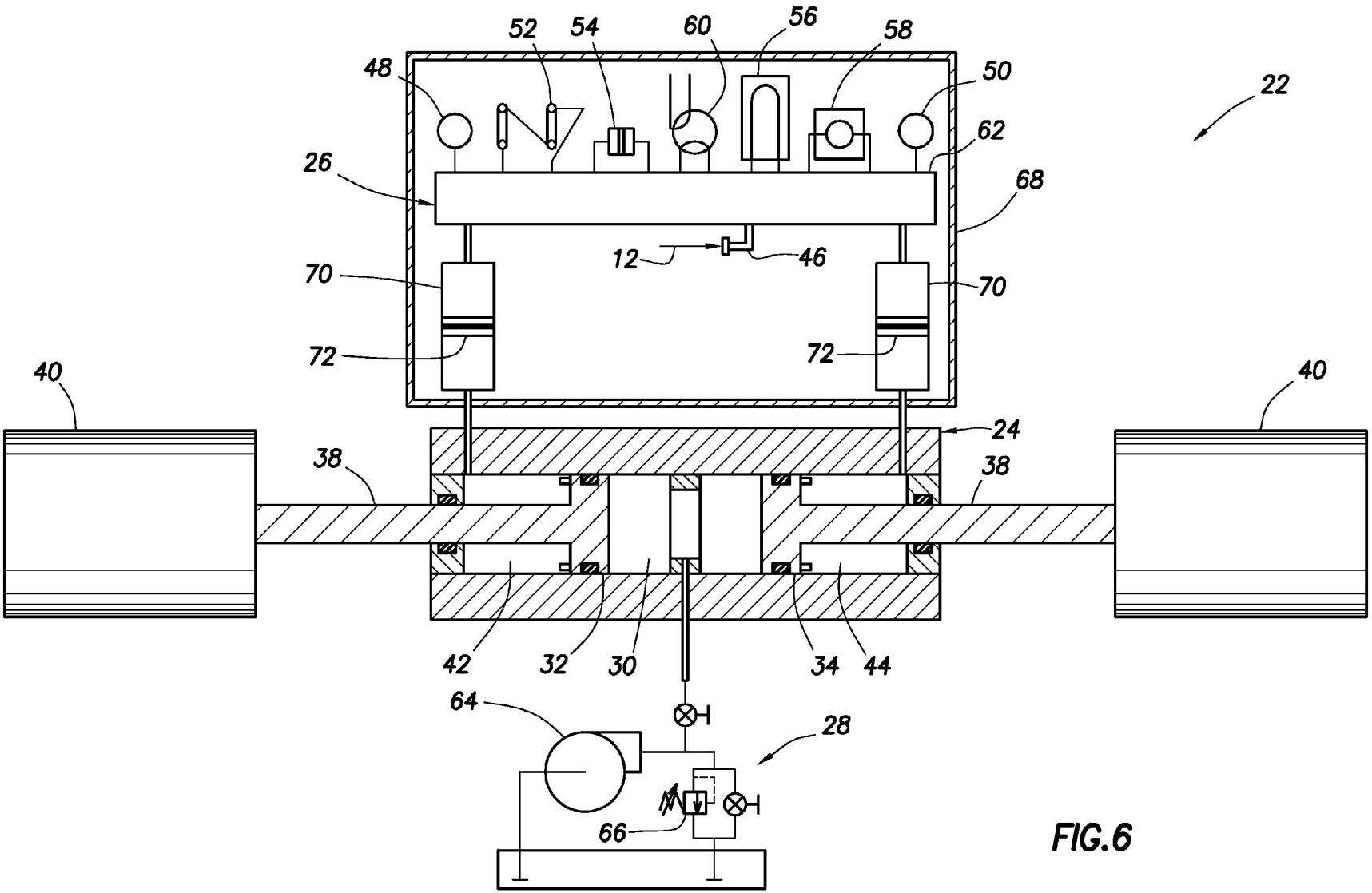
FIG. 6 is a representative partially cross-sectional diagram of another configuration of the fluid test system.

Referring additionally now to FIG. 6, another configuration of the test system 22 is representatively illustrated. In this configuration, the manifold assembly 26 is positioned in an oven 68, so that the sample can be heated to a desired temperature (such as, at or near a temperature of the formation 14 from which the fluid 12 originated), but it is not desired to position the pump 24 (including the actuators 40, pressure source 28, etc.) in the oven.

In this example, the fluid 12 sample is isolated from the pump 24 by, e.g., cylinders 70 having floating pistons 72 therein. Thus, the annular chambers 42, 44 could be filled with another fluid (such as hydraulic fluid), so that when the pistons 32, 34 are displaced, the fluid 12 sample is still flowed through the test manifold 62, but the fluid 12 is not itself transferred between the annular chambers 42, 44. Instead, fluid is transferred from one of the annular chambers 42, 44 to one of the cylinders 70, and fluid is transferred from the other of the annular chambers to the other of the cylinders.

Therefore, it will be appreciated that the pump 24 can be used for pressurizing and flowing fluids other than formation fluids. Furthermore, the pump 24 can be useful in operations other than formation fluid testing. For example, the pump 24 could be used in other applications where a relatively highly pressurized fluid is to be flowed at a relatively high flow rate (although the pump could be also be used to advantage where such high pressures and flow rates are not required).

The above disclosure provides to the art a pump 24 which can comprise two pistons 32, 34, each piston 32, 34 having one side exposed to a support pressure, and another side exposed to a respective one of two annular chambers 42, 44, the annular chambers 42, 44 being pressurized greater than the support pressure. Fluid is discharged from one annular chamber 42, 44 and received into the other annular chamber 42, 44 in response to displacement of the pistons 32, 34.

The pistons 32, 34 can comprise opposing pistons, whereby the first sides of the pistons face each other.

The support pressure may be contained in a fluid chamber 30 positioned between the pistons 32, 34.

The annular chambers 42, 44 may be connected to a fluid property sensor 48, 50, 52, 54, 56, 58.

A fluid 12 test sample may flow through a test manifold 62 in response to a force being applied to at least one of the pistons 32, 34.

Pressure in the annular chambers 42, 44 may increase in response to an increase in the support pressure.

The annular chambers 42, 44 can be in fluid communication with each other (such as, via the test manifold 62).

Reciprocation of the pistons 32, 34 preferably transfers fluid back and forth between the annular chambers 42, 44.

Displacement of the pistons 32, 34 may pump a fluid 12 test sample through a test manifold 62.

The pump 24 may include at least one actuator 40 which displaces the pistons 32, 34.

Also described above is a method of testing a fluid 12. The method can include pressurizing the fluid 12 in response to increasing a support pressure exposed to a first side of each of two pistons 32, 34, thereby increasing pressure in two annular chambers 42, 44 exposed to respective second sides of the pistons 32, 34; and then displacing the pistons 32, 34, thereby flowing the fluid 12 through a test manifold assembly 26.

The test manifold assembly 26 may comprise at least one fluid property sensor 48, 50, 52, 54, 56, 58.

Displacing the pistons 32, 34 may include reciprocating the pistons 32, 34, thereby flowing the fluid 12 back and forth through the test manifold assembly 26.

Pressure in the annular chambers 42, 44 preferably increases at a greater rate than the support pressure increases.

The method can also include heating the fluid 12.

The pressurizing step can comprise increasing a volume of a chamber 30 positioned between the pistons 32, 34.

The pressurizing step can comprise reducing volumes of the annular chambers 42, 44.

The annular chambers 42, 44 can be in fluid communication with each other during the step of displacing the pistons 32, 34.

The displacing step can also include reciprocating the pistons 32, 34, thereby transferring the fluid 12 back and forth between the annular chambers 42, 44.

The fluid 12 may comprise a formation fluid sample, or another type of fluid.

A fluid test system 22 described above can include a pump 24 having a support pressure exposed to a first side of each of two pistons 32, 34, and a second side of each of the pistons 32, 34 being exposed to a respective one of two annular chambers

42, 44. Each annular chamber 42, 44 is connected to at least one fluid property sensor 48, 50, 52, 54, 56, 58.

The sensor can comprise at least one of: a viscosity sensor 52, a densitometer 56, an optical sensor 54, pressure and temperature sensors 48, 50, a flowmeter, and an acoustic sensor 58.

A fluid 12 test sample may be contained in the annular chambers 42, 44. A fluid 12 test sample may flow through a test manifold 62 in response to a force being applied to at least one of the pistons 32, 34.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "left," "right," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A pump, comprising:

two pistons, each piston having a first side exposed to a support pressure and a second side exposed to a respective one of two annular chambers, the annular chambers being pressurized greater than the support pressure, wherein the pistons comprise opposing pistons, whereby the first sides of the pistons face each other, and wherein fluid is discharged from one annular chamber and received into the other annular chamber in response to displacement of the pistons.

2. The pump of claim 1, wherein the support pressure is contained in a fluid chamber positioned between the pistons.

3. The pump of claim 1, wherein the annular chambers are connected to a fluid property sensor.

4. The pump of claim 1, wherein a fluid test sample flows through a test manifold in response to a force being applied to at least one of the pistons.

5. The pump of claim 1, wherein pressure in the annular chambers increases in response to an increase in the support pressure.

6. The pump of claim 1, wherein the annular chambers are in fluid communication with each other.

7. The pump of claim 1, wherein reciprocation of the pistons transfers fluid back and forth between the annular chambers.

8. The pump of claim 1, wherein displacement of the pistons pumps a fluid test sample through a test manifold.

9. The pump of claim 1, further comprising at least one actuator which displaces the pistons.

10. A method of testing a fluid, the method comprising:

pressurizing the fluid in response to increasing a support pressure exposed to a first side of each of two pistons, thereby increasing pressure in two annular chambers exposed to respective second sides of the pistons; and then displacing the pistons, thereby flowing the fluid through a test manifold assembly.

11. The method of claim 10, wherein the test manifold assembly comprises at least one fluid property sensor.

12. The method of claim 10, wherein displacing the pistons further comprises reciprocating the pistons, thereby flowing the fluid back and forth through the test manifold assembly.

13. The method of claim 10, wherein pressure in the annular chambers increases at a greater rate than the support pressure increases.

14. The method of claim 10, further comprising heating the fluid.

15. The method of claim 10, wherein pressurizing further comprises increasing a volume of a chamber positioned between the pistons.

16. The method of claim 10, wherein pressurizing further comprises reducing volumes of the annular chambers.

17. The method of claim 10, wherein the annular chambers are in fluid communication with each other during the displacing.

18. The method of claim 10, wherein displacing further comprises reciprocating the pistons, thereby transferring the fluid back and forth between the annular chambers.

19. The method of claim 10, wherein the fluid comprises a formation fluid sample.

20. A fluid test system, comprising:

a pump having a support pressure exposed to a first side of each of two pistons, and a second side of each of the pistons being exposed to a respective one of two annular chambers, wherein pressure in the annular chambers increases in response to an increase in the support pressure, and wherein each annular chamber is connected to at least one fluid property sensor.

21. The fluid test system of claim 20, wherein the pistons comprise opposing pistons, whereby the first sides of the pistons face each other.

22. The fluid test system of claim 20, wherein the support pressure is contained in a fluid chamber between the pistons.

23. The fluid test system of claim 20, wherein the sensor comprises at least one of the group comprising a viscosity sensor, a densitometer, an optical sensor, a pressure sensor, a temperature sensor, a flowmeter, and an acoustic sensor.

24. The fluid test system of claim 20, wherein a fluid test sample is contained in the annular chambers.

25. The fluid test system of claim 20, wherein a fluid test sample flows through a test manifold in response to a force being applied to at least one of the pistons.

26. The fluid test system of claim 20, wherein the annular chambers are in fluid communication with each other.

27. The fluid test system of claim 20, wherein reciprocation of the pistons pumps fluid back and forth between the annular chambers.

28. The fluid test system of claim 20, wherein displacement of the pistons pumps fluid through a test manifold.

* * * * *